US006420948B1

(12) United States Patent
Runyan

(10) Patent No.: US 6,420,948 B1
(45) Date of Patent: Jul. 16, 2002

(54) PARALLEL CONTACT CIRCUIT BREAKER

(75) Inventor: Daniel Runyan, Cambridge, MD (US)

(73) Assignee: Airpax Corporation, Inc., Frederick, MD (US)

( * ) Notice: Subject to any disclaimer, the term of this patent is extended or adjusted under 35 U.S.C. 154(b) by 0 days.

(21) Appl. No.: 09/830,173

(22) PCT Filed: Oct. 20, 1999

(86) PCT No.: PCT/US99/24468

§ 371 (c)(1),
(2), (4) Date: Apr. 23, 2001

(87) PCT Pub. No.: WO00/24012

PCT Pub. Date: Apr. 27, 2000

Related U.S. Application Data

(63) Continuation of application No. 09/176,169, filed on Oct. 21, 1998, now Pat. No. 6,034,586.

(51) Int. Cl.[7] ..... H01H 9/00; H01H 43/02; H01H 73/08

(52) U.S. Cl. ..... 335/6; 335/38; 335/39; 335/41; 335/59; 335/60; 335/62; 335/172; 335/174; 335/175; 335/176

(58) Field of Search ..... 335/6, 8, 9, 38–41, 335/59–67, 172–176, 239, 240

(56) References Cited

U.S. PATENT DOCUMENTS 3,497,838 A * 2/1970 Merriken et al. ..... 335/64
3,517,357 A * 6/1970 Bakes ..... 335/241
3,786,380 A * 1/1974 Harper ..... 335/10
3,815,059 A * 6/1974 Spoelman ..... 200/325
3,943,316 A * 3/1976 Oster ..... 200/336
3,943,472 A * 3/1976 Oster et al. ..... 335/147
3,943,473 A * 3/1976 Khalid ..... 335/147
3,944,953 A * 3/1976 Oster ..... 335/174
3,946,346 A * 3/1976 Oster et al. ..... 335/16
3,959,755 A * 5/1976 Harper et al. ..... 335/240
4,062,052 A * 12/1977 Harper et al. ..... 335/59
4,085,393 A * 4/1978 Grenier ..... 335/202
4,117,285 A * 9/1978 Harper ..... 200/293
4,276,526 A * 6/1981 Ciarcia et al. ..... 335/16
4,347,488 A * 8/1982 Mune et al. ..... 335/8
4,427,959 A * 1/1984 Chuzawa ..... 335/239
4,437,488 A * 3/1984 Taggart et al. ..... 137/334
4,492,941 A * 1/1985 Nagel ..... 335/13
4,528,531 A * 7/1985 Flick et al. ..... 335/191
4,612,430 A * 9/1986 Sloan et al. ..... 200/325
4,618,751 A * 10/1986 Wehr et al. ..... 218/151
4,912,441 A * 3/1990 Runyan et al. ..... 335/185
5,053,736 A * 10/1991 Fasano ..... 335/177
5,066,935 A * 11/1991 Harper ..... 335/172
5,117,208 A * 5/1992 Nar ..... 335/172
5,162,765 A * 11/1992 DiVincenzo et al. ..... 335/172
5,214,402 A * 5/1993 DiVincenzo et al. ..... 335/167
5,223,681 A * 6/1993 Buehler et al. ..... 218/22
5,231,365 A * 7/1993 Kato ..... 335/132
5,293,016 A * 3/1994 Nar ..... 200/400
5,343,178 A * 8/1994 Bagalini ..... 335/59
5,444,424 A * 8/1995 Wong et al. ..... 335/172
5,463,199 A * 10/1995 Divincenzo et al. ..... 218/156
5,557,082 A * 9/1996 Leet et al. ..... 200/50.35
5,565,828 A * 10/1996 Flohr ..... 218/1
5,874,877 A * 2/1999 Kawashima et al. ..... 335/132
6,034,586 A * 3/2000 Runyan et al. ..... 218/152

* cited by examiner

*Primary Examiner*—Ramon M. Barrera
(74) *Attorney, Agent, or Firm*—Milde & Hoffberg, LLP

(57) ABSTRACT

A parallel pole magnetohydraulic circuit breaker (10), having a single trip element (271) and a pair of trip mechanisms (101, 102), achieving an increased current carrying capacity with reduced nuisance trips. The tip mechanisms (101, 102) are contained within separate housings (14, 16), with electrical connections (30, 40) and multipole trip mechanism (101, 102) communicating through apertures in the common wall (14'). Preferably, the armature (260) of the trip element (271) acts on a single trip mechanism (101, 102), which multiplies the available force to trigger a trip of the other tip mechanism.

17 Claims, 5 Drawing Sheets

PARALLEL CONTACT CIRCUIT BREAKER

The present application is a 371 of PCT/US99/24468, filed Oct. 20, 1999, which is a continuation of U.S. patent application Ser. No. 09/176,169, filed Oct. 21, 1998, now U.S. Pat. No. 6,034,586, issued Mar. 7, 2000.

FIELD OF THE INVENTION

The present invention relates to the field of circuit breakers, and more particularly to multipole circuit breakers in which contact sets are paralleled in order to increase breaker capacity rating.

BACKGROUND OF THE INVENTION

In the field of electrical circuit breakers, it is well known to tie the mechanisms of a plurality of electrical poles, or independent circuit paths, together. In this case, it is often desired to provide a single control lever and a trip mechanism which operates the electrical contacts in synchrony. See, U.S. Pat. Nos. 5,565,828; 5,557,082, 4,492,941, and 4,347,488, expressly incorporated herein by reference.

A single pole circuit breaker is a device that serves to interrupt electrical current flow in an electrical circuit path, upon the occurrence of an overcurrent in the circuit path. On the other hand, a multipole circuit breaker is a device which includes two or more interconnected, single pole circuit breakers which serve to substantially simultaneously interrupt current flow in two or more circuit paths upon the occurrence of an overcurrent in any one circuit path.

In a multipole circuit breaker, typically the poles switch independent phases of AC current. Thus, two-pole and three-pole breakers are well known. In these systems, each pole is provided with a current sensing element to generate a trip signal, so that an overload on any phase circuit is independently sensed. In the event that an overload occurs, all of the phase circuits are tripped simultaneously. A manual control lever is provided which operates the phase circuits synchronously as well.

Conventional multipole circuit breaker arrangements thus include a trip lever mechanism associated with each pole of the multipole circuit breaker. Each trip lever includes a portion for joining it to adjacent trip levers. If any pole is tripped open by an overcurrent, the breaker mechanism of that pole causes the trip lever to pivot about its mounting axis. The pivotal motion of one lever causes all the interconnected trip levers to similarly pivot. Each lever may include an arm for striking the armature or toggle mechanism of its respective pole, and causing each pole to be tripped open.

In order to increase the capacity of a circuit breaker system, it has been proposed to parallel a set of contacts, each of which might be insufficient alone to handle the composite load. Thus, by paralleling two single pole circuit breaker elements, a higher capacity circuit breaker may be achieved. However, the art teaches that, preferably, a single contact set is provided having a larger surface area and greater contact force in order to handle a larger load. These larger load-handling capacity devices are typically dimensionally larger than lower load carrying designs. This is because, in part, many elements within a circuit breaker scale in size in relation with current carrying capacity, including the lugs, trip elements, trip mechanism, contacts and breaker arm.

In designing a trip element or system, the type of load must be considered. There are two main classes of trip elements; thermal magnetic and magnetohydraulic. These differ in a number of characteristics, and typically have different application in the art.

However, where such contact parallelization is employed, the contact ratings of the breaker should be derated from the sum of current carrying capacity of each of the contact sets. This is because a contact set having a lower impedance than others will "hog" the current, and may thus see a significantly greater proportion of the total current than 50%, resulting in overheating, and possible failure. Therefore, the art typically teaches that a pair of paralleled contact sets are derated, by for example about 25%, to ensure that each component will operate within its safe design parameters. Further, the contact resistance of a switch may change significantly with each closure of the switch. In parallel contact systems, it is known to employ both unitary thermal magnetic and multiple parallel-operating trip elements in multipole breakers. Thus, it is possible to design a circuit breaker with a specially designed trip element that controls an entire breaker system, or to parallel two entire breaker circuits of a multipole arrangement. In the later case, in order to equalize the current as much as possible between the circuits, a current equalization bar has been proposed. However, this does not compensate for unequal contact resistance, and nuisance tripping of the circuit breaker results when the unequal division of the current has caused enough current to pass through one of the current sensing devices to cause it to trip its associated mechanism.

Attempts have been made in thermal-type breakers to parallel the sets of contacts of a multipole breaker to achieve increased maximum current rating. In one case, exemplified by model QO12150 from Square-D Corp., a unitary thermal magnetic trip element was employed as a trip element for a set of two parallel contact sets, with a connecting member to trip both contact sets at the same time. In this case, the trip dynamics were defined by the thermal-magnetic trip element, and careful calibration of the thermal element was required. This design provided both contact sets within a common housing. Thus, while the internal parts were common with non-multipole arrangements, the housing itself was a special multipole breaker housing. The parallel breaker is housed in a shell that differs from single pole housings, with the parallel poles in a common space.

One typical known system is disclosed in U.S. Pat. No. 4,492,941, expressly incorporated herein by reference, provides electromagnetic sensing devices that are electrically connected at one of their ends to the load terminals. The load terminals are electrically connected in parallel with each other. A plurality of electromagnetic sensing devices are electrically connected at their other ends to each other and are electrically connected to all of the movable contacts which are themselves all electrically connected together. The stationary contacts are connected to line terminals that are also electrically connected in parallel with each other. Thus, the electromagnetic sensing devices are connected in parallel at both of their ends and the contact sets are also connected in parallel at both of their electrical ends, while the electromagnetic sensing devices, on the one hand, and the contact sets, on the other hand, are also in series with each other, thus seeking to equally divide the current among all of the electromagnetic sensing devices, even though the current may not be equally divided among all of the relatively movable contacts, because of varying contact resistances.

Another attempt to increase current carrying capability by paralleling contact sets using magnetohydraulic trip elements employed two parallel trip elements, each set for a desired derated value corresponding to half of the total desired current carrying capacity. For example, two 100 Amp breakers were paralleled (using a standard multipole trip bar) to yield a 150 Amp rated breaker, with 175% trip (about 250 Amps) rating, meeting UL 1077. The parallel set of breakers employed two side-by-side single breaker housings, with slight modifications, and thus did not require new tooling for housings and contact elements.

In this later case, it is difficult to comply with UL 489, which requires that the breaker trip at 135% maximum of rated capacity and 200% of rated capacity within 2 minutes, and that the breaker be capable of handling the specified loads without damage. For example, if the maximum expected deviation in contact resistance of the contact sets (which changes each time the contact is closed) could cause a current splitting ratio of 60%/40%, then in order to ensure reliable trip at 135% of total rated capacity, each trip element must be designed to trip at about 120% of rated capacity, which would lead to unreliability and nuisance trips because of insufficient margin.

Notwithstanding the foregoing attempts, it has heretofore been considered difficult to employ magnetohydraulic circuit breakers in parallel contact multipole breakers with relatively low overcurrent thresholds, such as that imposed by UL 489, especially for use in load environments with high peak to average load ratios, because the maximum expected currents would result in nuisance trips.

A main advantage of parallel contact circuit breakers is that these may employ many parts in common with lower current carrying single pole devices. It is thus often economically desirable to increase the current carrying capacity of circuit breakers by modifying as little as possible, existing circuit breakers. Toward this end, it has been proposed that the amount of current carrying capacity may be almost doubled by placing two single pole circuit breakers side-by-side (or almost tripled by using three side-by-side) and connecting the line terminals together and likewise connecting the load terminals together.

Commercial circuit breaker manufacturers generally manufacture a complete product line composed of a number of breaker sizes, each one covering a different (although sometimes overlapping) operating current range. Each breaker size typically has required its own component and case sizes. In general, each component and case size combination is useful in circuits having only a single current rating range. The need to have a different set of component and case sizes for each current rating has added to the overall cost of breakers of this general type.

As discussed above, there are two common types of trip elements for circuit breakers. A first type, called a thermal magnetic breaker, provides a thermal portion having a bimetallic element that responds to a heat generated by a current, as well as a solenoid to detect magnetic field due to current flow. Typically, the thermal element is designed to trigger a trip response at a maximum of 135% average of rated capacity, and the magnetic element responds quickly (within milliseconds) at 200% of rated capacity. The thermal portion of the breaker controls average current carrying capability, by means of thermal inertia, while the magnetic element controls dynamic response. This design seeks to provide adequate sensitivity while limiting nuisance trips. However, such thermal magnetic designs typically require calibration of the thermal trip mechanism for precision, and tuning of dynamic response is difficult. Further, the thermal element incurs a wattage loss. The operation of the thermal element is also sensitive to ambient temperature, since the heating of the bimetallic element by the current flow is relative to the ambient temperature. See, U.S. Pat. Nos. 3,943,316, 3,943,472, 3,943,473, 3,944,953, 3,946,346, 4,612,430, 4,618,751, 5,223,681, and 5,444,424.

A second type of trip element is called a magnetohydrodynamic or magnetohydraulic breaker. See, U.S. Pat. Nos. 4,062,052 and 5,343,178. In this element, the current passes through a solenoid coil wound around a plastic bobbin, acting on static pole piece and a movable armature. Within the solenoid coil is a moveable magnetically permeable core, which is held away from the pole piece in a damping fluid, e.g., a viscous oil, by a spring. As a static current through the coil increases, the core is drawn toward the pole piece through the viscous fluid, resulting in a nonlinear increase in force on the armature, which lies beyond the pole piece, as the moveable core nears contact with the pole piece. Thus, as the moveable core is pulled toward the pole piece, the magnetic force on the armature suddenly increases and the armature rapidly moves. In this case, it is primarily the spring constant of the spring which controls the precision of the trip element, and thus a final calibration is often unnecessary given the ease of obtaining precision springs. In the event of a dynamic current surge, the core is damped by the fluid, and thus does not rapidly move toward the pole piece, resulting in a dynamic overload capability, determined by the viscosity of the damping fluid, and thus avoiding nuisance trips. The armature is typically counterbalanced and may be intentionally provided with an inertial mass to provide further resistance to nuisance trips.

Nuisance tripping is a problem in applications where current surges are part of the normal operation of a load, such as during motor start-up or the like. For example, starting up of motors, particularly single phase, AC induction types, may result in high current surges. Motor starting in-rush pulses are usually less than six times the steady state motor current and may typically last about one second, but may be 10 or more times the steady state current. In the later case, a breaker may revert to an instantaneous trip characteristic, because the magnetic flux acting on the armature is high enough to trip the breaker without any movement of the delay tube core or heating of the thermal element, depending on the design. One way to address this problem is by increasing the distance between the coil and armature.

A second type of short duration, high current surge, commonly referred to as a pulse, is encountered in circuits containing transformers, capacitors, and tungsten lamp loads. These surges may exceed the steady state current by ten to thirty times, and usually last for between two to eight milliseconds. Surges of this type will cause nuisance tripping in conventional delay tube type electromagnetic circuit breakers. This problem may be addressed by increasing the inertia of the trip element or by other means. See, U.S. Pat. Nos. 4,117,285, 3,959,755, 3,517,357, and 3,497,838, expressly incorporated herein by reference.

SUMMARY AND OBJECTS OF THE INVENTION

The applicants have found that a single magnetohydraulic trip element can advantageously be used to provide desired trip dynamics in a circuit breaker by passing all current from a set of parallel contact sets through a unitary trip element, and providing a multipole trip arm triggered by the unitary trip element which trips the parallel contact sets simultaneously.

The preferred design employs parallel circuit breaker poles each having a trip mechanism, switch contacts and a housing, which share most components in common with a single pole circuit breaker in the same "family", thus reducing required number of inventoried parts and engineering costs. The trip element of the preferred design, however, differs from single pole designs, being configured for the desired ratings and dynamic response, and portions of the housing between adjacent poles are modified for common access to electrical terminals to bridge the load and to provide a standard type multipole trip bar. The magnetohydraulic trip element, which is preferably a 150 Amp element with desired dynamic trip characteristics, sits asymmetrically in one of the pole housings within a standard frame, in the normal trip element position, and actuating a standard armature.

The external lugs of each poles are made electrically parallel by placing a conductive bar therebetween. This also serves the visual function of alerting the installer as to the electrical function of the breaker, which is similar to a multipole breaker that is not paralleled. Internally, one set of lugs are connected together with conductive straps to one end of the magnetic coil. The other end of the magnetic coil is connected with conductive straps to each of the contact arms. In order to provide physical access for these connections, a portion of each of the common walls of the breaker pole housings are machined to form an aperture or portal therebetween.

The modifications to the standard single pole housing are minimized; other than the portal in the common wall between the poles, the only other modifications are, for example, an arcuate slot for a common trip mechanism, and an arcuate slot for an internal linkage of the manual switch handles. In the preferred embodiment, however, the handles are linked externally by a crossbar, which fits between the handles and causes them to move in unison. In this way, the standard mountings for the handle, pivot axis of the moveable contact bar, stationary contact, and arc chute and slot motor are unaffected. Further, the safety factors of the design remain relatively intact.

A preferred design provides two parallel switch poles with a design rating of 100 Amps each, in a housing 2.5 inches long, 0.75 inches wide, and 2 inches deep, with electrical contact bolts on 2 inch centers. The resulting parallel multipole design with a rating of 150 Amps therefore fits within a form factor of 2.5 by 1.5 by 2 inches, a substantial improvement over prior 150 Amp rating circuit breakers.

It should be seen that the form factor may be varied according to the present invention, for example other standard size circuit breakers which may be formed as multipole parallel contact breakers are, for example, 2 inches long, by 0.75 inches wide, by 1.75 inches deep (e.g., 50 Amp rating) and 7.25 inches long by 1.5 inches wide by 3 inches deep (e.g., 250 Amp rating).

The present invention may incorporate other known circuit breaker features, such as a mid-trip stop for the manual control lever or other trip indicators, and indeed may be formed into a traditional multipole design with parallel sets of contacts for each of multiple switch poles.

It is also seen that, while the preferred embodiments employ housing parts which are common in essential design with single pole designs, that this is not a limitation on the operability of the inventive design.

It is therefore an object of the invention to provide a magnetohydrodynamic circuit breaker which has a low average overcurrent trip capability with good nuisance trip immunity.

It is also an object of the present invention to provide a circuit breaker having a high current rating and a small form factor.

It is a further object of the invention to provide a circuit breaker having a set of parallel contacts, driven by a trip mechanism, wherein all of the contact sets are tripped by a common magnetohydrodynamic trip element.

These and other objects will be apparent from an understanding of the preferred embodiments.

BRIEF DESCRIPTION OF THE DRAWINGS

These and further objects and advantages of the invention will be more apparent upon reference to the following specification, claims and appended drawings wherein:

DETAILED DESCRIPTION OF THE PREFERRED EMBODIMENTS

Figure 1:
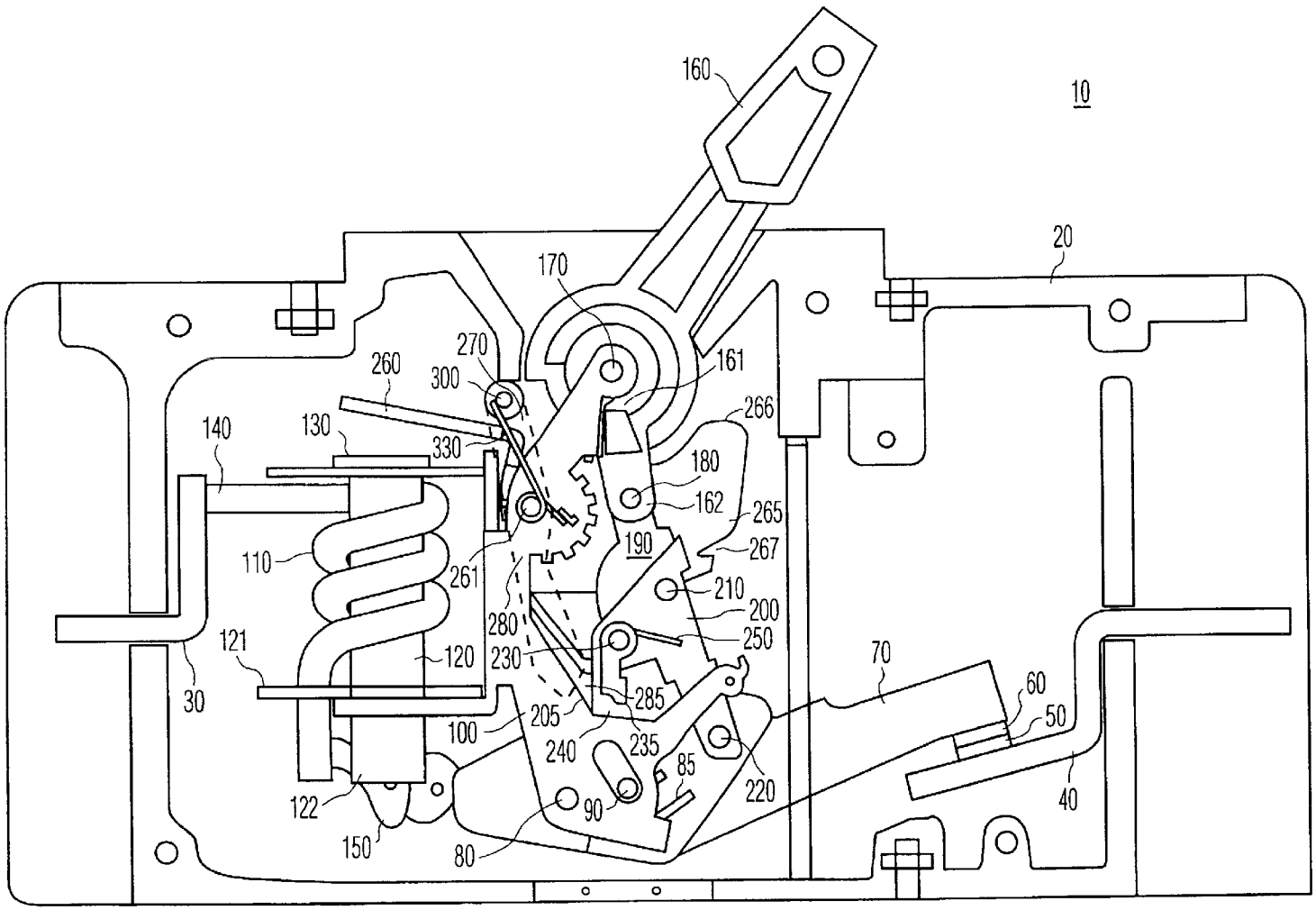
FIG. 1 is a side view of a single pole breaker mechanism having a housing half removed.

The preferred embodiments will no be described by way of example, in which like reference numerals indicate like elements.

EXAMPLE

Figure 2B:
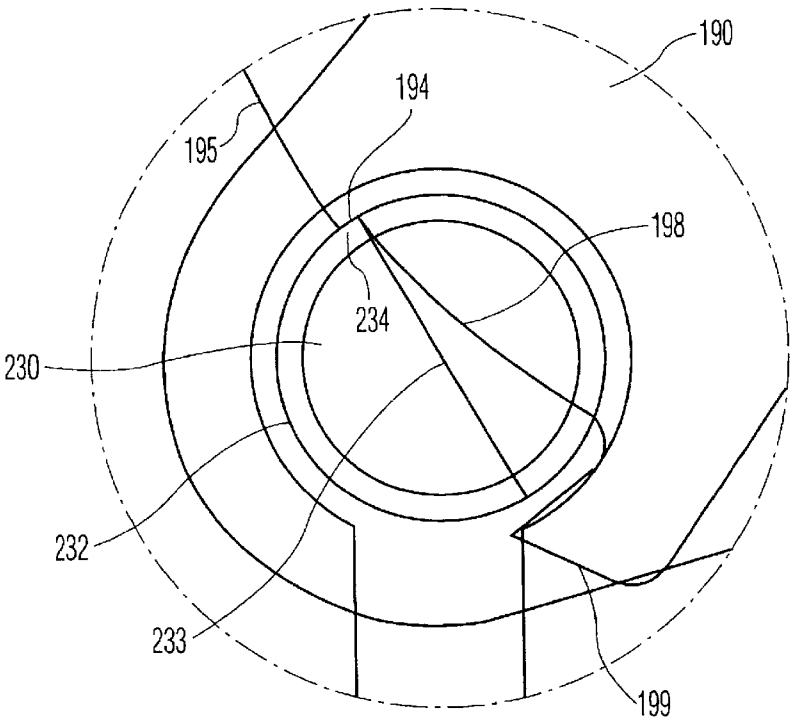
FIGS. 2A and 2B are detail views of a known breaker toggle mechanism.
Figure 2A:
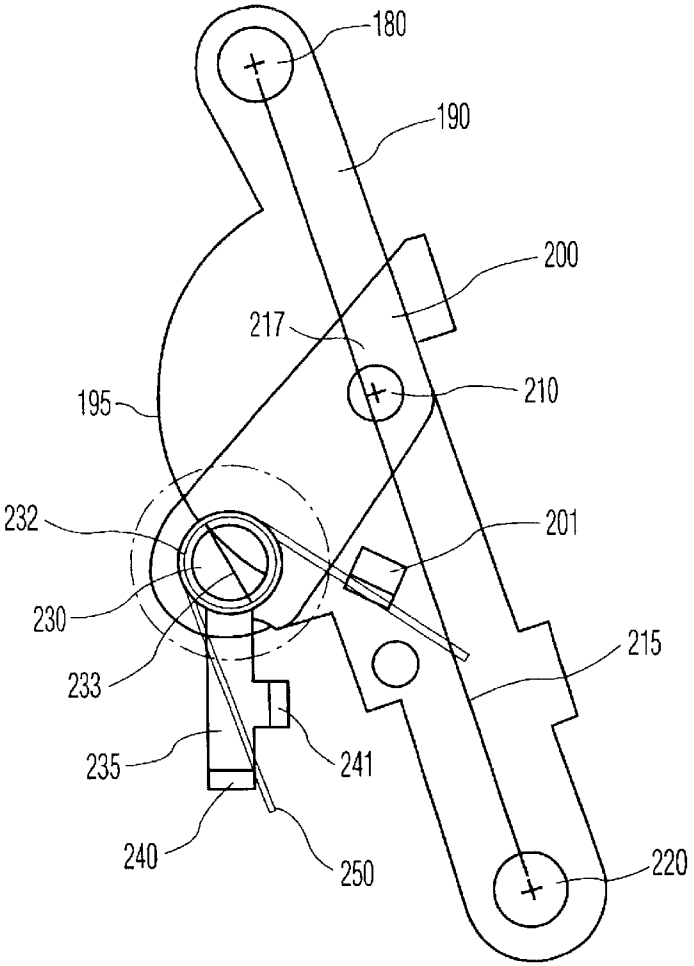

Components of a conventional type single pole circuit breaker are depicted in FIGS. 1, 2A and 2B. See, U.S. Pat. No. 5,293,016, expressly incorporated herein by reference. As shown, the single pole circuit breaker 10 includes an electrically insulating casing 20 which houses, among other things, stationary mounted terminals 30 and 40. In use, these terminals are electrically connected to the ends of the electrical circuit that is to be protected against overcurrents.

As its major internal components, a circuit breaker includes a fixed electrical contact, a movable electrical contact, an electrical arc chute, a slot motor, and an operating mechanism. The arc chute is used to divide a single electrical arc formed between separating electrical contacts upon a fault condition into a series of electrical arcs, increasing the total arc voltage and resulting in a limiting of the magnitude of the fault current. See, e.g., U.S. Pat. No. 5,463,199, expressly incorporated herein by reference. The slot motor, consisting either of a series of generally U-shaped steel laminations encased in electrical insulation or of a generally U-shaped, electrically insulated, solid steel bar, is disposed about the contacts to concentrate the magnetic field generated upon a high level short circuit or fault current condition, thereby greatly increasing the magnetic repulsion forces between the separating electrical contacts to rapidly accelerate separation, which results in a relatively high arc resistance to limit the magnitude of the fault current. See, e.g., U.S. Pat. No. 3,815,059, incorporated herein by reference.

The trip mechanism includes a contact bar, carrying a movable contact of the circuit breaker, which is spring loaded by a multi-coil torsion spring to provide a force repelling the fixed contact. In the closed position, a hinged linkage between the manual control toggle is held in an extended position and provides a force significantly greater than the countering spring force, to apply a contact pressure between the moveable contact and the fixed contact. The hinged linkage includes a trigger element which, when displaced against a small spring and frictional force, causes the hinged linkage to rapidly collapse, allowing the torsion spring to open the contacts by quickly displacing the moveable contact away from the fixed contact. The trigger element is linked to the trip element.

As is known, the casing 20 also houses a stationary electrical contact 50 mounted on the terminal 40 and an electrical contact 60 mounted on a contact bar 70. Significantly, the contact bar 70 is pivotally connected via a pivot pin 80 to a stationary mounted frame 100. A helical spring 85, which encircles the pivot pin 80, pivotally biases the contact bar 70 toward the frame 100 in the counterclockwise direction per FIG. 1. A contact bar stop pin 90 or contact bar stop mounted on the contact bar 70 (or optionally other stop, such as a surface which contacts the frame), limits the pivotal motion of the contact bar 70 relative to the frame 100 in the non-contacting position (contact bar 70 rotated about pin 80 in the counterclockwise direction to separate contacts 50 and 60, not shown in FIG. 1). By virtue of the pivotal motion of the contact bar 70, the contact 60 is readily moved into and out of electrical contact with the stationary contact 50. In the contacting position (shown in FIG. 1), the stationary contact 50 limits the motion of the contact 60, thus limiting the angular rotation of the contact bar 70 about pin 80. The pivot pin 80 sits in a conforming aperture in the frame, while a slot 81 is provided in the contact bar 70 to allow a small amount of vertical displacement. Thus, in the contacting position, the contact bar 70 may be displaced vertically by the pressure of the toggle linkage composed of cam link 190 and link housing 200 in the aligned relative orientation (shown in FIG. 1), against a force exerted by the helical spring 85.

An electrical coil 110, which encircles a magnetic core 120 topped by a pole piece 130, is positioned adjacent the frame 100. An extension 140 of the coil material, typically a solid copper wire, or an electrical braid, serves to electrically connect the terminal 30 to one end of the coil 110. An electrical braid 150 connects the opposite end of the coil 110 to the contact bar 70. Thus, when the contact bar 70 is pivoted in the clockwise direction (as viewed in FIG. 1), against the biasing force exerted by the spring 85, to bring the contact 60 into electrical contact with the contact 50, a continuous electrical path extends between the terminals 30 and 40.

Magnetic core 120 includes a delay tube. By way of example only, the coil and delay tube assembly may be of the type shown and described in U.S. Pat. No. 4,062,052, expressly incorporated herein by reference.

Magnetic core 120 has at an upper position thereof, a pole piece 130. Adjacent pole piece 130 is an armature 260 pivotally mounted on a pin 261 secured to frame 100. Armature 260 is rotatably biased in a clockwise direction (relative to FIG. 3) by a spring (not shown), and comprises an arm 265 and a counterweight 266. Counterweight 266 comprises an enlarged extension of armature 260, and may include a slot 267 for receiving a pin of an inertia wheel rotatably mounted on frame 100, not shown. See, U.S. Pat. Nos. 3,497,838, 3,959,755, 4,062,052, and 4,117,285, expressly incorporated herein by reference.

The delay tube of the magnetic core 120 is a typical design, which is disclosed, for example, in U.S. Pat. No. 4,062,052, expressly incorporated herein by reference. In this design, an outer tube 122 of the magnetic core 120 is supported in the frame 100 by a bobbin 121, about which the coil 110 is wound. The outer tube is a drawn single piece shell, sealed at its open end by the pole piece 130. The interior of the delay tube is conventionally filled with a viscous fluid 123 such as oil. Typically, the viscosity of the oil is selected to provide a desired damping within a standard delay tube design, although mechanical modifications, most notably with respect to the clearance around a magnetic delay core 124 (not shown in FIG. 1) or slug in the outer tube 122, will also influence the damping or delay of the system. The construction materials of the magnetic delay core or slug and pole piece 130 may also alter the force induced by the coil 110. The delay core or slug is biased away from the pole piece 130 by a helical spring 125 provided within the outer shell 122. For example, the delay core has an enlarged lower end and a reduced diameter upper end around which a portion of spring passes and defining an annular shoulder against which the lower end of spring bears. In conventional circuit breaker delay tubes, the distance from the bottom of the core to the plane containing the bottom of the coil 110, is customarily chosen to be about one-third of the overall interior distance of the delay tube, namely from the bottom of the core to the underside of the pole piece 130. Customarily, the coil 110 surrounds the upper two-thirds of the delay tube outer shell 122. This conventional construction optimizes the delay function of the tube while, at the same time, maintaining the overall length of the tube within reasonable bounds.

When a prolonged overcurrent passes through coil 110, delay core moves upwardly in the outer shell 122, with motion damped by the viscous oil, to compress spring until the upper end of delay core engages pole piece 130, causing an increased magnetic flux in the gap between the pole piece 130 and armature 260, so that the armature 260 is attracted to the pole piece 130 and rotates about its pivot 261 to engage the sear striker bar 240 to result in collapse of the toggle mechanism, separating the electrical contacts and opening the circuit in response to the overcurrent, as will become apparent below.

The circuit breaker 10 also includes a handle 160, which is pivotally connected to the frame 100 via a pin 170. Handle 160 includes a pair of ears 162 with apertures for receiving a pin 180, which connects handle 160 to a cam link 190. In addition, a toggle mechanism is provided, which connects the handle 160 to the contact bar 70. The handle 160 is provided with a helical spring 161, which applies a counterclockwise force on the handle 160 about pin 170 with respect to frame 100. A significant feature of the cam link 190, shown in expanded view in FIG. 2B, is the presence of a step, formed by the intersection of non-parallel surfaces 194 and 198, in the outer profile of the cam link 190. Cam link 190 is pivotally connected by a rivet or pin 210 to a housing link 200.

With further reference to FIGS. 2A and 2B, the toggle mechanism of the circuit breaker 10 also includes a link housing 200, which is further connected a projecting arm 205. The link housing is pivotally connected to the cam link 190 by a pin or rivet 210 and pivotally connected to the contact bar 70 by a rivet 220.

The toggle mechanism further includes a sear assembly, including a sear pin 230 which extends through an aperture in the link housing 200 generally corresponding to a location of an outer edge 195 of the cam link 190. This sear pin 230 includes a circularly curved surface 232 (see FIG. 2B) which is intersected by a substantially planar surface 233. The sear assembly also includes a leg 235 (see FIG. 2A), connected to the sear pin 230, and a sear striker bar 240, which is connected to the leg 235 and projects into the plane of the paper, as viewed in FIG. 2A. A helical spring 250, which encircles the sear pin 230, pivotally biases the leg 235 of the sear assembly clockwise, into contact with the leg 205 of the link housing 200, and biasing the planar surface 233 of the sear pin 230 into substantial contact with the bottom surface 198 of the step in the cam link 190. A force exerted against the sear striker bar 240 is transmitted to the leg 235, and acts as a torque on the sear pin 230 to angularly displace the substantially planar surface 233 of the sear pin 230 from coplanarity the surface 198 of the cam link 190, thus raising the leading edge 234 of the substantially planar surface 233 of the sear pin 230 above the top edge of the surface 194. This rotation results in elimination of a holding force for the contact bar 70 in the contacting position, generated by the helical spring 85 acting on the contact arm 70, through the rivet 220 and link housing 200 and sear pin 230 leading edge 234, against the surface 194 of the cam link 190, acting on the pin 180, ears 162 of handle 160, held in place by pin 170 with respect to the casing 20 and frame 100.

The initial clockwise rotation of the cam link 190 is limited by a hook 199 in the outer profile of the cam link 190, at a distance from the step, which partially encircles, and is capable of frictionally engaging, the sear pin 230. In addition, the distance from the step to the hook 199 is slightly larger than the cross-sectional dimension, e.g., the diameter, of the sear pin 230. This dimensional difference determines the amount of clockwise rotation the cam link 190 undergoes before this rotation is stopped by frictional engagement between the hook 199 and the sear pin 230.

As a consequence, the sear pin 230 engages the step in the cam link 190, i.e., a portion of the surface 194 of the cam link 190 overlaps and contacts a leading portion of the curved surface 232 of the sear pin 230. Thus, it is by virtue of this engagement that the toggle mechanism is locked and thus capable of opposing and counteracting the pivotal biasing force exerted by the spring 85 on the contact bar 70, thereby maintaining the electrical connection between the contacts 50 and 60.

By manually pivoting the handle 160 in the counterclockwise direction (as viewed in FIG. 1), the toggle mechanism, while remaining locked, is translated and rotated out of alignment with the pivotal biasing force exerted by the spring 85 on the contact bar 70. This biasing force then pivots the contact bar 70 in the counterclockwise direction, toward the frame 100, resulting in the electrical connection between the contacts 50 and 60 being broken, thus assuming a noncontacting position. When in the full counterclockwise position, the handle 160 applies a slight tension or no force on the cam link 190, resulting in a full extension of the cam link 190 with respect to the link housing 200. In this position, the leading edge of the surface 232 of the sear pin 230 engages the surface 194, and thus the toggle mechanism is in its locked position. Therefore, manually pivoting the handle 160 from the left to right, i.e., in the clockwise direction, then serves to reverse the process to close the contacts 50, 60, since a force against the action of spring 85 is transmitted by clockwise rotation of the handle to the contact bar 70.

As shown in FIG. 1, the armature 260, pivotally connected to the frame 100, includes a leg 265 which is positioned adjacent the sear striker bar 240. In the event of an overcurrent in the circuit to be protected, this overcurrent will necessarily also flow through the coil 110, producing a magnetic force which induces the armature 260 to pivot toward the pole piece 130. As a consequence, the armature leg 265 will strike the sear striker bar 240, pivoting the sear pin 230 out of engagement with the step (intersection of surfaces 194, 198) in the cam link 190, thereby allowing the force of spring 85 to collapse the toggle mechanism. In the absence of the opposing force exerted by the toggle mechanism, the biasing force exerted by the spring 85 on the contact bar 70 will pivot the contact bar 70 in the counterclockwise direction, toward the frame 100, resulting in the electrical connection between the contacts 50 and 60 being broken.

As a safety precaution, the operating mechanism is configured to retain a manually engageable operating handle 160 in its ON or an intermediate, tripped position, if the electrical contacts 50, 60 are welded together. Thus, the handle 160 will not assume the OFF position if the contacts are held together. In addition, if the manually engageable operating handle 160 is physically restricted or obstructed in its ON position, the operating mechanism is configured to enable the electrical contacts 50, 60 to separate upon a trip, e.g., due to an overload condition or upon a short circuit or fault current condition. See, U.S. Pat. No. 4,528,531, expressly incorporated herein by reference.

Two or more single pole circuit breakers 10 are readily interconnected to form a multipole circuit breaker. In this configuration, each such single pole circuit breaker 10 further includes, as depicted in FIG. 1, a trip lever 270 (shown in dotted line) which is pivotally connected to the frame 100 by pin 261, which also is the pin about which the armature 260 pivots. The trip lever 270 is generally U-shaped and includes arms 280 (shown in FIG. 1) and 290 (not shown in FIG. 1) which at least partially enfold the frame 100. A helical spring 330, positioned between the frame 100 and the arm 280 and encircling the pin 162, pivotally biases the trip lever toward the frame 100. A projection 300 of the trip lever 270, which, as viewed in FIG. 1, projects out of the plane of the paper, is intended for insertion into a corresponding aperture 301 in the trip lever of an adjacent single pole circuit breaker. Thus, any pivotal motion imparted to the trip lever 270, in opposition to the biasing force exerted by the spring 330, is transmitted to the adjacent trip lever, and vice versa. The projection 300 and aperture of a trip lever of an adjacent breaker, are preferably tapered, to ensure a secure fit therebetween. When the toggle link collapses, a protrusion 291 (not shown in FIG. 1) from the contact bar 70 displaces a cam surface 292 of the arm 290, thus rotating the trip lever about pin 261, and displacing the projection 300. The projection 300 thus moves in an arc about the pin 261, and thus an arcuate slot is provided in a housing half of housing 20 to transmit forces through the projection 300. A portion of arm 280 acts directly on the sear striker bar 240, to trip the associated toggle mechanism of an adjacent switch pole. A protrusion from the frame, for example a stop, limits the motion of arm 290 of the trip lever 270, in response to a bias spring about the pivot axis. Thus, Since the trip lever 270 is not operated directly by the armature 260, the trip dynamics of the circuit breaker are unaffected. The drag on the trip mechanism from the trip lever 270 is insignificant.

Side 280 has a cam surface 285, having a bend of about 45 degrees, which engages the sear striker bar 240 at about the position of the bend. Side 290 has a bend 293, forming cam surface 292, which is perpendicular with the portion of the side 290. Protrusion 291 extends from the side of the moveable contact bar 70, which contacts the surface 292 midway through the travel of the contact bar 70. When the contact bar 70 is displaced, the protrusion 291 pushes against the surface 292, causing a rotation about the pin 261, causing the surface 285 of side 280 to displace the sear striker bar 240. It is clear that in operation, rotation of trip lever 270 about pin 261 will result in tripping of the toggle mechanism, and tripping of the toggle mechanism will result in rotation of the trip lever about the pin 261. See, e.g., U.S. Pat. Nos. 5,557,082, 5,214,402, 5,162,765, 5,117,208, 5,066,935, and 4,912,441, and also U.S. Pat. Nos. 4,492, 941, 4,437,488, 4,276,526, and 3,786,380, expressly incorporated herein by reference.

In addition to the above-described "master" pole, adjacent thereto is provided a "slave" pole. This "slave" pole is identical to the "master" pole with the exception that it lacks the coil 110, magnetic core 120, pole piece 130, and armature 260. The projection 300 passes through aligned arcuate slots in the respective case walls between the adjacent "master" and "slave" switch pole housings 20. The trip lever 271 in the "slave" pole, like the trip lever 270 of the "master" pole, receives a torque with respect to its frame from the tapered projection 300, extending laterally from the "master" pole housing 20 into the "slave" pole housing 20, into a tapered recess of the trip lever 271 of the "slave" pole. As the trip lever 271 in the "slave" pole rotates, it applies a force to the "slave" pole sear striker bar 240, which in turn rotates the "slave" pole sear pin 230 about its axis, resulting in collapse of the "slave" pole toggle mechanism 102. Thus, when the "master" mechanism 101 trips or is manually switched OFF, the "slave" mechanism 102 trips slightly thereafter. A dual ended rod 302 connects the handle 160 of the master and slave circuit breakers so that they move in unison.

Figure 3A:
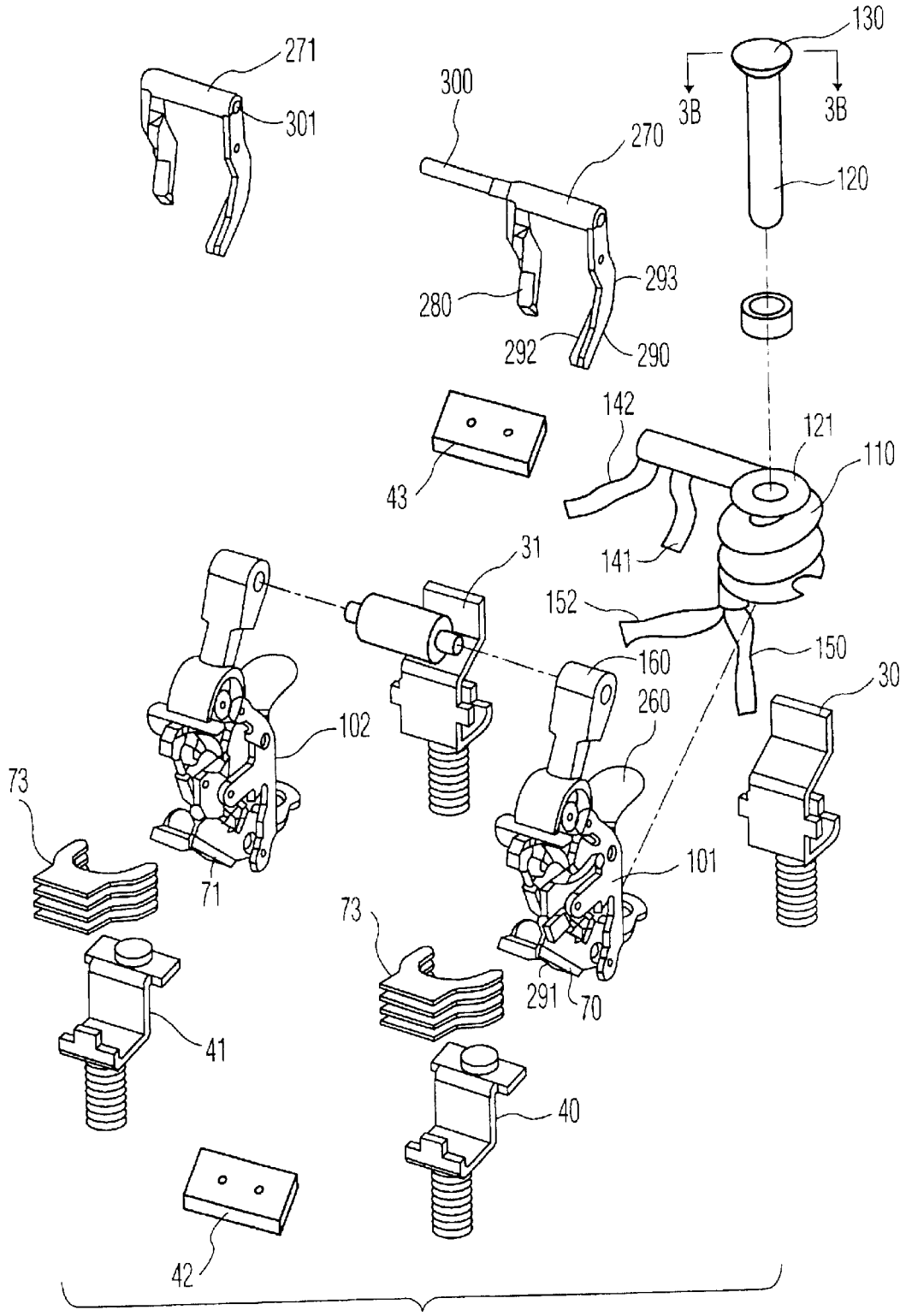
FIG. 3A is an exploded view of a parallel pole master/slave circuit breaker of a slightly different base design than FIG. 1.
Figure 3B:
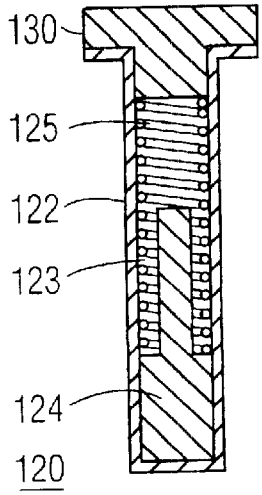
FIG. 3B shows a cutaway view of a delay tube shown in FIG. 3A.
Figure 4B:
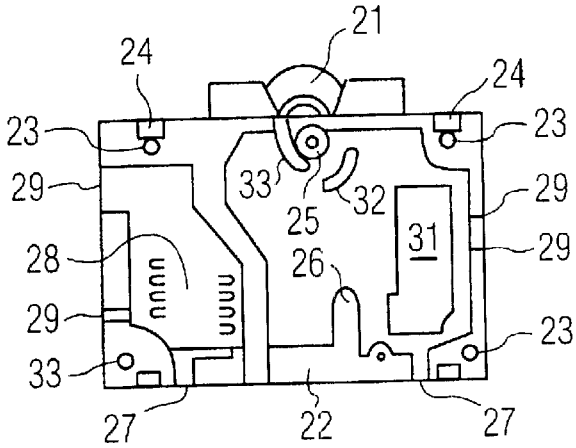
FIGS. 4A and 4B shown, respectively, an exploded view of a housing structure, and a side view of an inner case half, for the master/slave circuit breaker according to FIG. 3A.
Figure 4C:
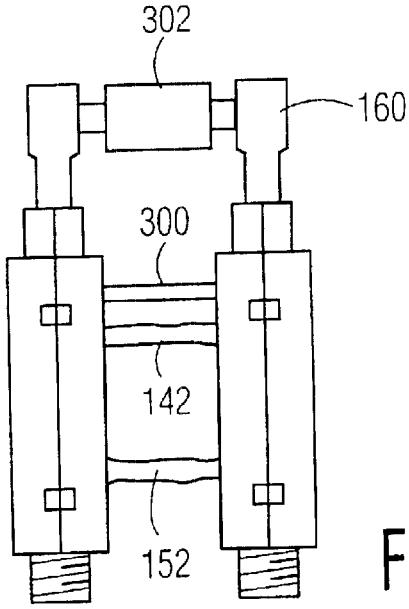
FIG. 4C shows a partial assembly drawing of exploded view 4A, with a gap between the master housing and slave housing, revealing the electrical and mechanical connections between interconnecting the respective housings.
Figure 4A:
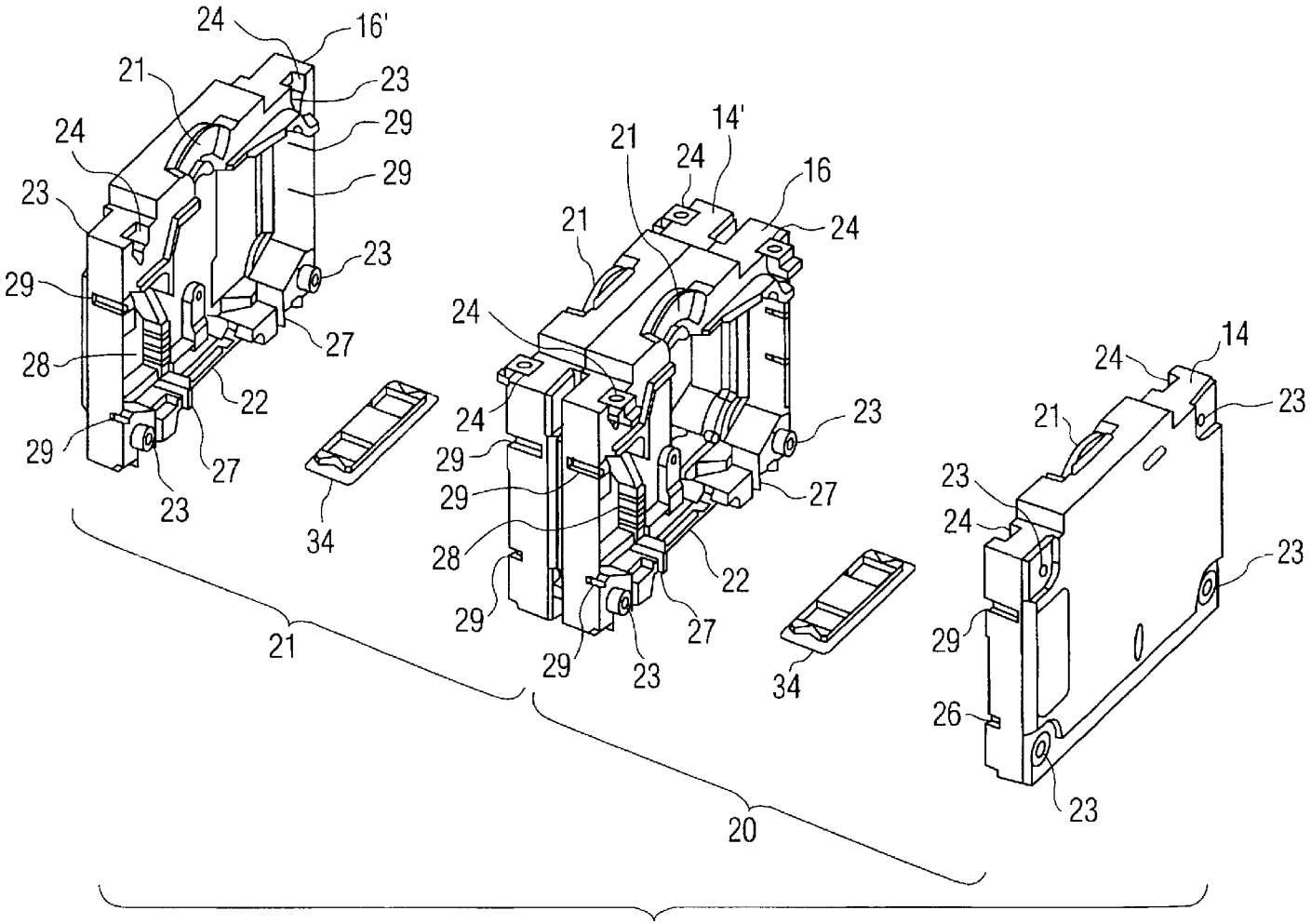

As shown in FIG. 3, an electrical braided wire 141 serves to connect the terminal 30 in the "master" pole and an electrical braid 142 serves to electrically connect the terminal 31 in the "slave" pole to one end of the coil 110. Electrical braids 150, 152 connect the opposite end of the coil 110 to the contact bars 70, 71 of the "master" and "slave" poles, respectively. Electrical braid 151 passes through a rectangular portal formed in both adjacent case halves. The end of the coil 110 extends through the portal, so that electrical braid 142 does not have to pass through the portal, and indeed, to facilitate connection, the braid 141 may partially or completely pass through the portal to join the end of coil 110. Conductive plates 43, 42 are provided for bridging the lug connections 30, 31 and 40, 41, respectively, to ensure low impedance between the "master" and "slave" mechanisms.

To extinguish arcing caused by opening of the contacts 50 and 60, a stacked array of metal plates 73 (shown in FIG. 3) are supported within and by the two half cases 14 and 16 of the circuit breaker housing 20 around the moveable contact arm 70.

Each housing casing half 14, 16 includes the following features: An upper boss (half) for the toggle handle 21; a lower access port 22; a set of four rivet holes for assembly 23; a pair of half-recesses for a mounting nut 24; a first pivot recess for the handle pin 25; a second pivot recess for the contact arm pin 26; a pair of half-recesses for electrical contact lugs 27; a set of indentations for supporting the arc chute members 28; and a number of side port halves 29. In addition, each respective inner case half 16, 14' of the "master" and "slave" housing, respectively, has a number of apertures. First, a generally rectangular portal 31 is provided for paralleling the electrical connections from the pair of lug contacts 30, 31 and the movable contact bars 70, 71. Second, an arcuate aperture 32 is provided for the projection 300 of the trip lever 270. Optionally, an arcuate slot 33 is provided for an internal pin connecting the manual operation handles, causing them to operate synchronously. A cover 34 is provided to close each of the lower access ports. Each of the "master" and "slave" housings 20 are about 2.5 inches long, 0.75 inches wide, and 2 inches deep, with electrical contact bolts on 2 inch centers, each being individually rated at about 100 Amps. The resulting parallel multipole design with a rating of 150 Amps therefore fits within a form factor of 2.5 by 1.5 by 2 inches, The invention may be embodied in other specific forms without departing from the spirit or essential characteristics thereof. The present embodiments are, therefore, to be considered in all respects as illustrative and not restrictive, the scope of the invention being indicated by the appended claims rather than by the foregoing description, and all changes which come within the meaning and range of equivalency of the claims are, therefore, intended to be embraced therein. The term "comprising", as used herein, shall be interpreted as including, but not limited to inclusion of other elements not inconsistent with the structures and/or functions of the other elements recited.

What is claimed is:

1. A circuit breaker, comprising:

(a) a common magnetohydrodynamic load sensor; and (b) at least two sets of interruptable electrical contacts, each having an associated trip mechanism and a rated load capacity, wherein said magnetohydrodynamic load sensor responds to a sensed load by tripping at least one set of interruptable electrical contacts, and is adapted to sense a load exceeding said rated capacity of a single set of interruptable electrical contacts and within a composite load capacity of said at least two sets of interruptable electrical contacts in parallel.

2. The circuit breaker according to claim 1 wherein said magnetohydrodynamic load sensor comprises an inductive coil having first and second ends, said inductive coil surrounding a magnetically permeable core, said magnetically permeable core being displaceable against a spring force in response to a current flowing through said inductive coil, a movement of said magnetically permeable core being damped by a viscous fluid, and an armature, disposed proximate to an end of said inductive coil such that a current in said inductive coil induces a magnetic field which acts to attract said armature, wherein the magnetohydrodynamic load sensor trips said trip mechanism of a set of interruptable electrical contacts when a sufficient magnetic force is generated to displace said armature.

3. The circuit breaker according to claim 1 wherein each set of interruptable electrical contacts comprises a fixed contact and a displaceable contact disposed on a spring loaded pivoting contact arm, and wherein said trip mechanism comprises a collapsible toggle link mechanism.

4. The circuit breaker according to claim 1, wherein each of said sets of interruptable electrical contacts is connected on one side to said common magnetohydrodynamic load sensor and splitting an electrical current passing therethrough.

5. The circuit breaker according to claim 1, wherein each of the sets of interruptable electrical contacts is electrically parallel.

6. The circuit breaker according to claim 1, wherein said common magnetohydrodynamic load sensor trips a first set of interruptable electrical contacts, and a trip of said first set of interruptable electrical contacts trips a second set of interruptable electrical contacts.

7. The circuit breaker according to claim 1, wherein said circuit breaker has a rated load capacity of about 150 Amps.

8. The circuit breaker according to claim 1, wherein said circuit breaker has a rated load capacity of about 150 Amps, comprising two sets of interruptable electrical contacts, each having a rated load capacity of about 100 Amps, said circuit breaker fitting in a housing about 2.5 inches long, 1.5 inches wide, and 2 inches deep.

9. The circuit breaker according to claim 1, wherein respective sets of interruptable electrical contacts are disposed in separate respective stacked housing compartments, each having at least one inner wall, each respective inner wall having at least one aperture formed therein.

10. The circuit breaker according to claim 9, wherein said trip mechanism of a first set of interruptable electrical contacts is interconnected with a trip mechanism of a second set of interruptable electrical contacts through said aperture.

11. The circuit breaker according to claim 10, wherein a sensing of an overload condition by said magnetohydrodynamic load sensor initiates a trip of a first set of interruptable electrical contacts through its associated trip mechanism, and said associated trip mechanism of said first set of interruptable electrical contacts initiates a trip of a second set of interruptable electrical contacts through its associated trip mechanism, to provide simultaneous tripping of said first and second sets of interruptable electrical contacts.

12. A circuit breaker, comprising:

(a) a master breaker, having within a first sub-housing a common magnetohydrodynamic load sensor having a trip load and a first set of interruptable electrical contacts, having a first trip mechanism and a first rated load capacity, wherein said trip load exceeds said first load capacity; and (b) a slave breaker, having within a second sub-housing a second set of interruptable electrical contacts, having a second trip mechanism and a second rated load capacity, wherein said magnetohydrodynamic load sensor responds to a load exceeding said trip load by tripping said first trip mechanism;

a trip of said first set of interruptable electrical contacts results in a tripping of said second set of interruptable electrical contacts; and a composite load capacity of said first set of interruptable electrical contacts and said second set of interruptable electrical contacts exceeds said trip load.

13. The circuit breaker according to claim 12, wherein an aperture is formed in adjacent walls of said first and second sub-housings to provide a mechanical signal from said first sub-housing to said second sub-housing indicating that said load exceeds said trip load.

14. A method for providing a high load capacity circuit breaker having a desired load capacity, comprising the steps of:

(a) providing a magnetodynamic load sensor at the desired load capacity;

(b) providing at least two set of electrical switch elements, each having a load capacity insufficient to meet the desired load capacity, but which in parallel meet the desired load capacity;

(c) wiring the sets of electrical switch elements in parallel;

(d) when the load exceeds the desired load capacity, causing an interrupter of the first of the electrical switch elements to trip and thereby to cease conducting; and (e) sensing a trip of the first of the electrical switch elements to cause an interrupter of a second of the electrical switch elements to trip and thereby to cease conducting, to thereby block current to the load.

15. The method according to claim 14, wherein each set of electrical switch elements is provided in a separate sub-housing, and wherein the magnetodynamic load sensor is situated primarily in a single one of said sub-housings.

16. The method according to claim 14, wherein each set of electrical switch elements comprises a fixed contact and a displaceable contact disposed on a spring loaded pivoting contact arm, and wherein the interrupter comprises a collapsible toggle link mechanism.

17. The method according to claim 14, wherein the magnetodynamic load sensor comprises an inductive coil having first and second ends, the inductive coil surrounding a magnetically permeable core, the magnetically permeable core being displaceable against a spring force in response to a current flowing through the inductive coil, a movement of the magnetically permeable core being damped by a viscous fluid, and an armature, disposed proximate to an end of the inductive coil such that a current in the inductive coil induces a magnetic field which acts to attract the armature, wherein the magnetodynamic load sensor trips the interrupter of a set of electrical switch elements when a sufficient magnetic force is generated to displace the armature.

* * * * *